United States Patent [19]

Smith

[11] Patent Number: 4,738,217

[45] Date of Patent: Apr. 19, 1988

[54] STERN CONVERSION SEAT AND RAISED CASTING PLATFORM

[75] Inventor: Delbert G. Smith, Little Falls, Minn.

[73] Assignee: Nordic Boat Company, Inc.

[21] Appl. No.: 41,856

[22] Filed: Apr. 22, 1987

[51] Int. Cl.[4] ..... B63B 35/00

[52] U.S. Cl. ..... 114/363; 297/118; 108/112; 108/11

[58] Field of Search ..... 114/255, 363; 108/11, 108/13, 17, 44, 48, 63, 108, 112, 115; 297/63, 118, 119, 129; 244/118.6

[56] References Cited

U.S. PATENT DOCUMENTS 1,502,250 7/1924 Hurst ..... 297/63

1,832,767 11/1931 Dameron ..... 297/63

4,567,845 2/1986 Smith ..... 114/363

*Primary Examiner*—Sherman D. Basinger

*Assistant Examiner*—Edwin L. Swinehart

*Attorney, Agent, or Firm*—Barnes, Kisselle, Raisch, Choate, Whittemore & Hulbert

[57] ABSTRACT

A boat stern seat and platform device which is easily convertible to provide either a pleasure boat having a bench seat with or without a backrest or a boat having an elevated platform. Preferably, for fishing the platform is adapted to receive an elevated pedestal seat. The conversion is easily and readily performed by one person and in all configurations, the device is free from any protruding hardware which might cause injury to persons or restrict their movement and is pleasing to the eye.

30 Claims, 3 Drawing Sheets

STERN CONVERSION SEAT AND RAISED CASTING PLATFORM

FIELD OF INVENTION

This invention relates to boats and more particularly to a convertible stern seat and raised platform for both pleasure and fishing uses.

BACKGROUND

An inboard or outboard pleasure boat of one type has a bench seat in the stern that provides an open cockpit interior and another type has a full width bench seat with a backrest. On the other hand, a fishing boat, particularly a bass fishing boat, has a raised platform usually with one or more elevated pedestal seats which render the boat unsuitable for use as a pleasure craft.

SUMMARY OF THE INVENTION

In accordance with this invention, the stern of a boat has a convertible seat and raised platform. Preferably, in a first position, the seat has no backrest and in a second position it has a backrest. Preferably, the raised platform is adapted to receive a pedestal for an elevated seat.

Objects, features and advantages of this invention are to enhance the desirability and versatility of a boat by making it readily and easily adaptable for both pleasure and sport fishing uses, provide a stern conversion seat and raised platform which can be readily and easily converted by one person, and is free of protruding hardware which might cause injury to persons or restrict their movement, visually appealing, rugged, durable, and of relatively simple design and economic manufacture and assembly.

DETAILED DESCRIPTION

These and other objects, features and advantages of this invention will be apparent from the following detailed description, appended claims and accompanying drawings, in which:

DESCRIPTION

Figure 1:
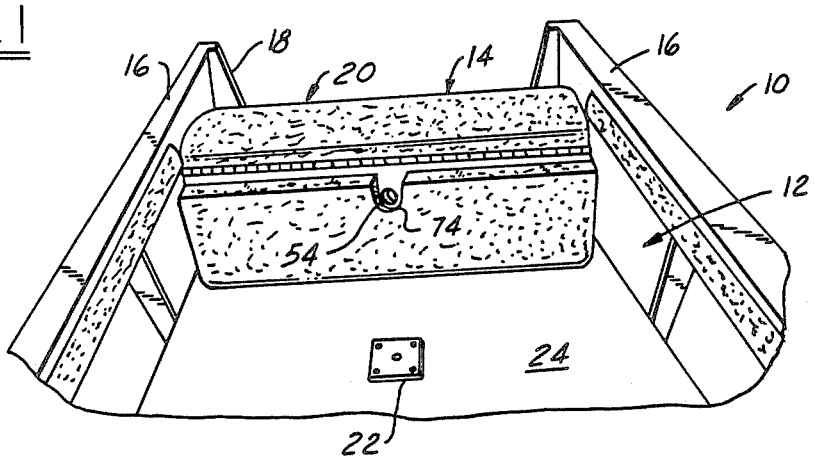
FIG. 1 is a fragmentary perspective view of a boat embodying a convertible stern seat and raised platform device of this invention shown in a first position with an open cockpit and a bench seat with no backrest.
Figure 2:
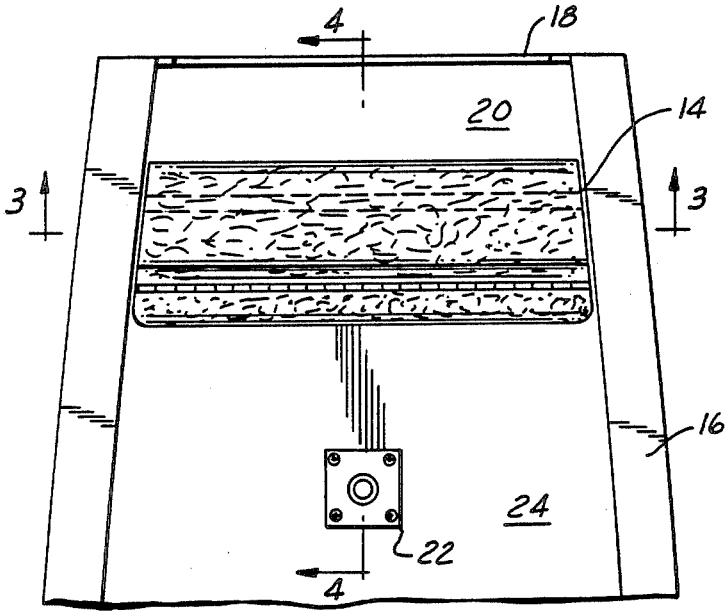
FIG. 2 is a fragmentary plan view of the boat of FIG. 1.
Figure 3:
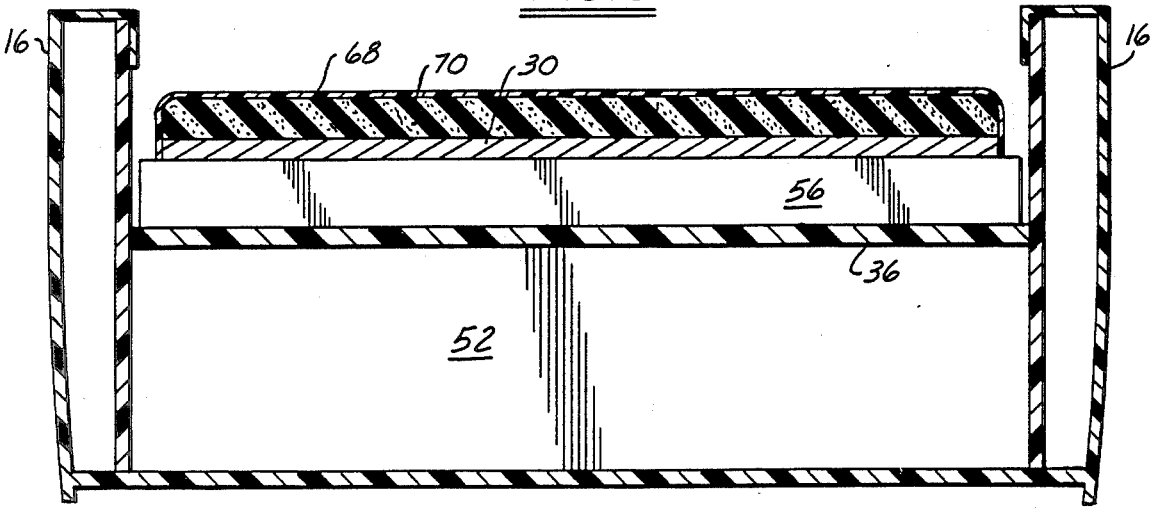
FIG. 3 is a sectional view taken generally along the line 3—3 in FIG. 2.

FIG. 1 illustrates a boat 10 having a cockpit 12 with a convertible stern seat and raised platform device 14 embodying this invention. The boat has sides 16, inner side panels 100, a transom 18 and a motor well 20. Preferably a pedestal support 22 is mounted on a floor panel 24, and adapted to receive and support a pedestal 26 of an elevated seat 28 (FIG. 6).

The convertible seat and raised platform device 14 has a plurality of interconnected panels, most of which have different functions depending on whether the device is in a seat or a platform configuration. As shown in FIG. 6, the device has first, second, third and fourth panels 30, 32, 34 and 36 pivotally connected together near adjacent longitudinal edges, preferably by piano hinges 38, 40 and 42. Preferably, the pivot points of hinges 38 and 40 are adjacent the upper faces of their associated panels and the pivot point of the hinge 42 is adjacent the lower faces of its associated panels. Preferably, hinges 38 and 40 are received in rabbets so they are flush with their associated panels. To facilitate moving the first panel through an arc of about 270 degrees, the adjacent edges 44 and 46 the first and second panels are beveled.

A fifth support panel 48 is pivotally connected preferably by a piano hinge 50 adjacent its upper longitudinal edge to the lower face of the third panel 34 adjacent its longitudinal edge associated with the hinge 40. To support the third panel 34, this fifth panel 48 can be moved to underlie and extend at generally a right angle to the third panel. Preferably, the fourth panel 36 is secured to the boat in a generally horizontal plane, by being fixed to an underlying bulkhead 52 extending transversely between and connected to the sides 16 of the boat or inner side panels 100.

Figure 6:
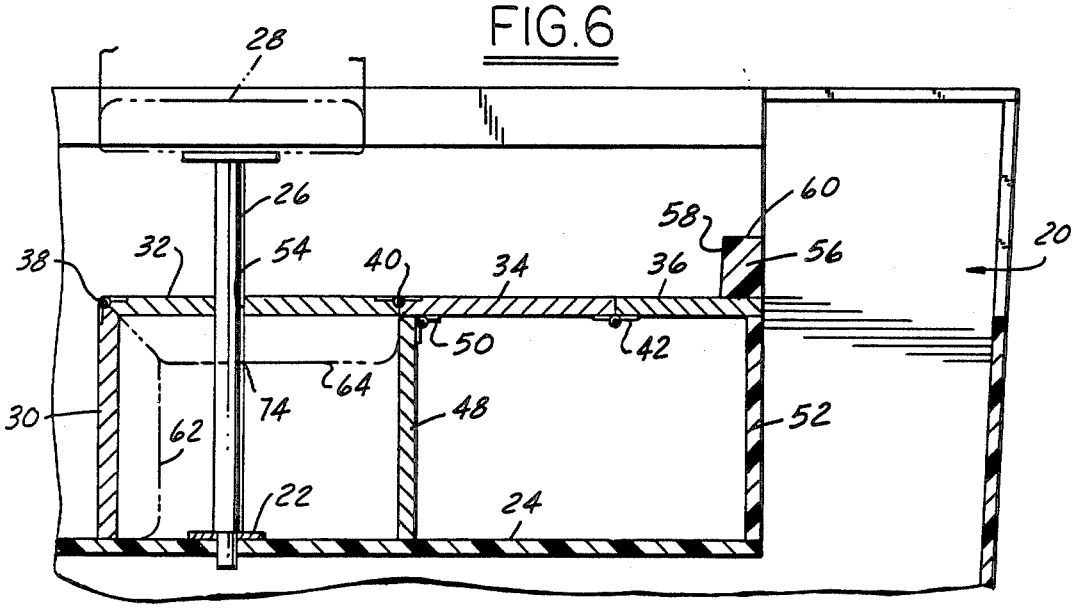
FIG. 6 is a sectional view similar to FIG. 4 but with the device shown in a third position with a raised platform and an elevated pedestal seat for fishing.

As shown in FIG. 6, the panels can be positioned and arranged to provide an elevated generally horizontal platform in the stern of the boat. This is accomplished by positioning the second, third and fourth panels 32, 34 and 36 so that they extend generally horizontally and the first and fifth panels 30 and 48 so they extend generally vertically and bear on the floor 24 to support the horizontally extending panels.

Preferably, to facilitate using the platform for fishing, a clearance hole 54 is provided through which the pedestal 26 of an elevated seat 28 can be received. The seat will be stabilized and prevented from generally laterally shifting or wobbling by this panel if the hole 54 has a close sliding fit with the pedestal 26.

Figure 5:
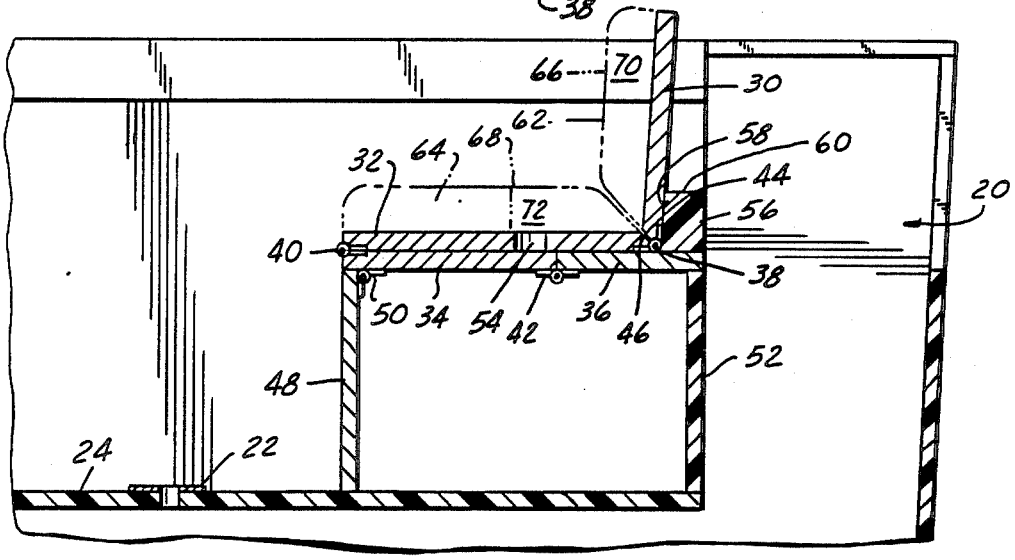
FIG. 5 is a sectional view similar to FIG. 4, but with the device shown in a second position with a full bench seat with a backrest.

As shown in FIG. 5, to provide a bench seat with a backrest, the second panel 32 is pivotally moved through an arc of about 180° so that it overlies and bears on the third and fourth panels. To provide a backrest, the first panel 30 is retained in a generally upright position by bearing on a positive stop which preferably is provided by a beam 56 extending longitudinally across the first panel. If desired, the beam 56 can be a structural member connected to the sides 16 of the boat or inner side panels 100. Preferably, the backrest is inclined somewhat at an obtuse included angle to the bench seat by inclining the complementary face 58 of the beam on which the panel 30 bears.

Figure 4:
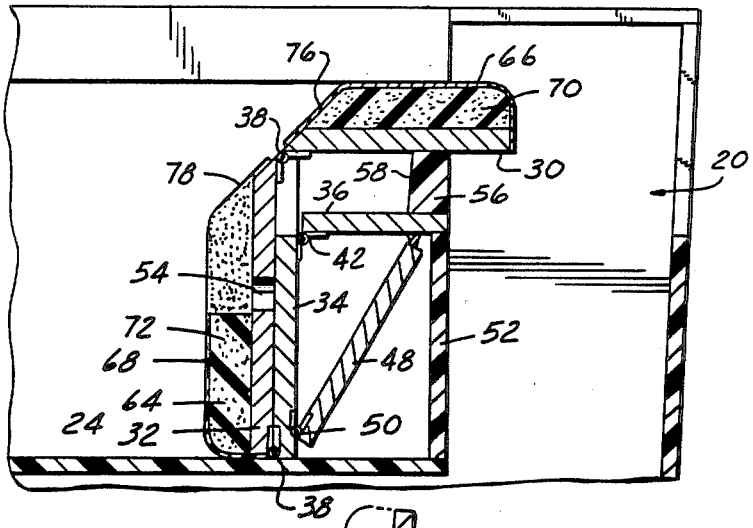
FIG. 4 is a sectional view taken generally along the line 4—4 in FIG. 2.

As shown in FIG. 4, the panels can also be positioned to provide a compact bench seat without a backrest which maximizes the usable floor space in the stern portion of the boat. This is accomplished by folding the panels to the position shown in FIG. 4. The fifth panel 48 is swung to an inclined position under the fourth panel 36, the second and third panels 32 and 34 are swung so they extend generally vertically adjacent the fourth panel 36, and the first panel 30 is extended generally horizontally to provide a bench seat. In this position, the first panel 30 bears on a positive stop provided by the upper face 60 of the beam. The inner edge of the first panel is supported either directly by the second panel 32 bearing on the floor 24 or indirectly by the third panel 34 bearing on the floor.

Preferably, cushions 62 and 64 are secured to the first and second panels. Desirably, the cushions have outer covers 66 and 68 of a flexible and waterproof material, such as vinyl, and pads 70 and 72 of a resilient material, such as foam rubber. To provide access to the hole 54, the cushion 64 has a cutout 74 therein. Preferably, the adjacent edges 76 and 78 of the cushions are beveled to facilitate positioning the first and second panels in the generally right angular position shown in FIGS. 5 and 6. To yieldably urge the first panel 30 into firm engagement with the stop block 56 when the panel is in the backrest position, as shown in FIG. 5, preferably the beveled edges 76 and 78 have a slight interference fit when in this position.

As shown in FIG. 6, when the panels are folded into the platform position, the cushions are shielded and protected by the first and second panels 30 and 32 from being struck and damaged and from becoming soiled and dirty from things being spilled or wiped on them.

Figure 7:
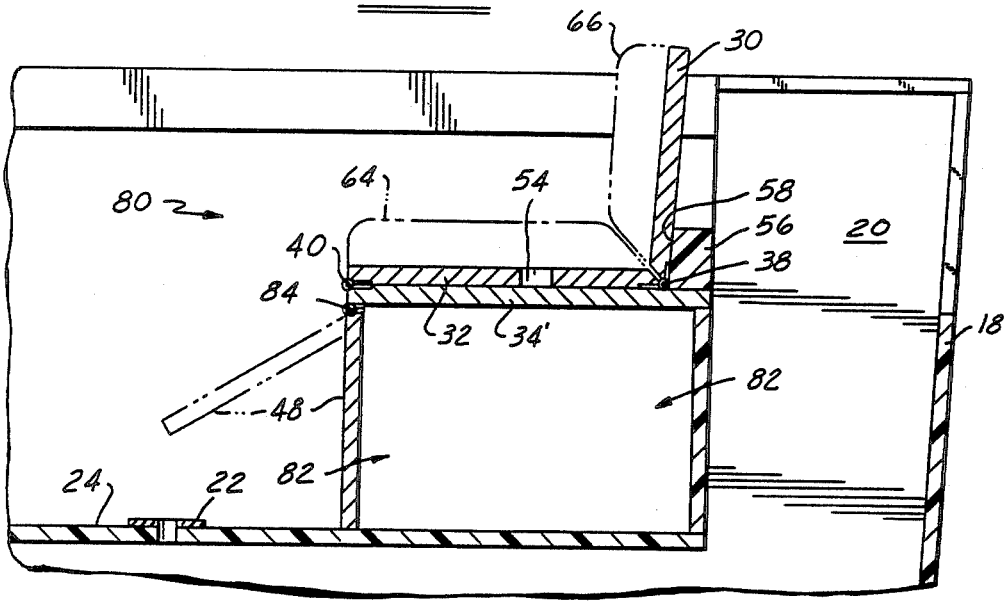
FIG. 7 is a sectional view similar to FIG. 5 of a modified two-position stern seat and raised platform device shown in its seat position.
Figure 8:
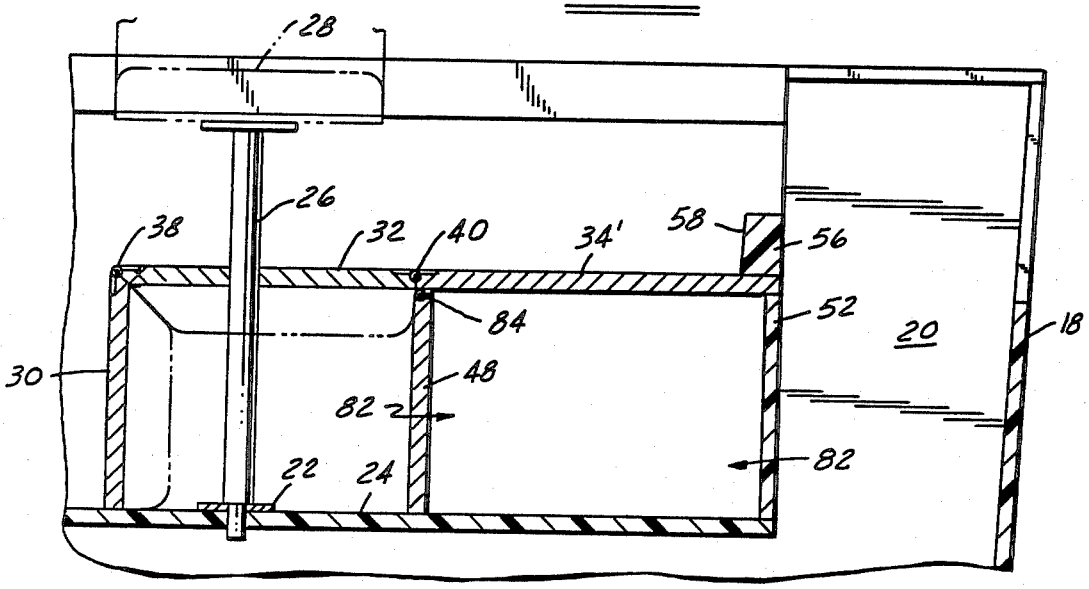
FIG. 8 is a sectional view similar to FIG. 6 of the modified device shown in its raised platform position with an elevated pedstal seat for fishing.

FIGS. 7 and 8 illustrate a modified device 80 embodying this invention which is movable to a first position providing a seat with a backrest (FIG. 7) and a second position providing an elevated platform (FIG. 8). This device has first and second panels 30 and 32 and a modified third panel 34'. Preferably, the modified third panel 34' has a width substantially equal to the combined widths of the panels 34 and 36 of the device 14 and is fixed to the boat. To provide an enclosed storage compartment 82, preferably the panel 48 is connected to the third panel 34' by a piano hinge 84 so that the panel can be pivotally raised as shown in phantom in FIG. 7 to provide access to the compartment. When the panel 48 is lowered or closed so that it extends generally vertically, preferably its lower edge bears on the floor 24 to provide additional support for the panel 34'.

If desired, the panel 48 can be eliminated which would provide an open compartment 82 or storage area. If desired, the compartment 82 can be eliminated while still providing support for the panel 34' by eliminating the hinge 84 and securing the panel 48 to the boat. If desired, hinge 38 can also be eliminated and the panels 30 and 32 rigidly secured together at generally a right angle to each other. If the first and second panels are rigidly secured together, the stop 58, and hence the beam 56, can also be eliminated.

In use of the device 80, the first and second panels 30 and 32 can be readily manually moved to the position shown in FIG. 7 to provide a seat with a backrest and the panel 32 pivoted through an arc of about 180° to the position shown in FIG. 8 to provide an elevated platform. In the seat position, the panel 32 bears on and is supported by the panel 34' and in the platform position, the panel 32 is supported by both the panel 34' and the panel 30 which preferably bears on the floor 24.

I claim:

1. A boat convertible stern seat and raised platform device which comprises:

first, second, third and fourth panels pivotally connected together near adjacent longitudinal edges;

a fifth support panel pivotally connected adjacent its upper longitudinal edge to the third panel adjacent a longitudinal edge;

means for supporting said fourth panel generally horizontally in the stern of a boat and extending longitudinally generally transversely to the sides of the boat;

said panels being constructed and arranged to be movable into positions providing an elevated generally horizontal platform, a bench seat with a backrest, and a bench seat without a backrest such that;

in the elevated platform position, the second, third and fourth panels extend generally horizontally, and the first and fifth panels extend generally vertically to support the horizontally extending second and third panels;

in the bench seat with a backrest position, the second, third and fourth panels extend generally horizontally with the second panel overlying the third and fourth panels to provide a seat, the first panel extends generally vertically to provide a backrest and the fifth panel extends generally vertically to support the third panel; and in the bench seat without a backrest position, the first panel extends generally horizontally to provide a seat; the second and third panels extend generally vertically adjacent the fourth panel and at least one of them supports the first panel, and the fifth panel is positioned under the fourth panel.

2. The device of claim 1 having a clearance hole through at least one of said second panel and third panels and constructed and arranged to receive and support a pedestal of an elevated seat.

3. The device of claim 1 having a clearance hole through said second panel and constructed and arranged to receive and support a pedestal of an elevated seat.

4. The device of claim 3 further comprising cushions secured to the first and second panels.

5. The device of claim 4 wherein said cushion secured to said second panel has a clearance hole for receiving a pedestal of an elevated seat.

6. The device of claim 4 wherein said cushions are resilient and are beveled at their adjacent longitudinal edges to facilitate positioning the first and second panels in generally right angular positions, and have a slight interference fit so as to yieldably urge the first panel into firm engagement with a positive stop when in the bench seat with a backrest position.

7. The device of claim 1 wherein said means for supporting the fourth panel comprises a bulkhead extending transversely between the sides of the boat.

8. The device of claim 1 wherein said means for supporting the fourth panel comprises two opposing sides of a boat, and means for securing said fourth panel to said opposing side.

9. The device of claim 1 further comprising a positive stop constructed and arranged to support said first panel in a generally vertical position when in the bench seat with a backrest position.

10. The device of claim 1 wherein said panels are pivotally connected by piano hinges.

11. The device of claim 1 further comprising a floor panel constructed and arranged to support said device.

12. A boat convertible stern seat and raised platform device which comprises:

first and second panels connected together near adjacent longitudinal edges;

a third panel pivotally connected to said panel near adjacent longitudinal edges;

means for supporting said third panel generally horizontally in the stern of a boat and extending longitudinally generally transversely to the sides of the boat;

said panels being constructed and arranged to be movable into positions providing an elevated generally horizontal platform, and a bench seat with a backrest such that in the elevated platform position, the second and third panels extend generally horizontally and the first panel extends generally vertically to support the horizontally extending second panel, and in the bench seat with a backrest position, the second and third panels extend generally horizontally with the second panel overlying the third panel to provide a seat, and the first panel extends generally vertically to provide a backrest.

13. The device of claim 12 having a clearance hole through at least one of said second panel and third panels and constructed and arranged to receive and support a pedestal of an elevated seat.

14. The device of claim 12 having a clearance hole through said second panel and constructed and arranged to receive and support a pedestal of an elevated seat.

15. The device of claim 14 further comprising cushions secured to the first and second panels.

16. The device of claim 15 wherein said cushion secured to said second panel has a clearance hole for receiving a pedestal of an elevated seat.

17. The device of claim 15 wherein said cushions are resilient and are beveled at their adjacent longitudinal edges to facilitate positioning the first and second panels in a generally right angular position.

18. The device of claim 12 wherein said means for supporting said third panel comprises a bulkhead extending transversely between the sides of the boat.

19. The device of claim 12 wherein said means for supporting said third panel comprises two opposing sides of a boat and means securing said third panel to said sides.

20. The device of claim 12 wherein said second and third panels are pivotally connected by a piano hinge.

21. The device of claim 20 wherein said first and second panels are pivotally connected by a piano hinge.

22. The device of claim 21 having a clearance hole through at least one of said second and third panels constructed and arranged to receive and support a pedestal of an elevated seat.

23. The device of claim 21 having a clearance hole through said second panel constructed and arranged to receive and support a pedestal of an elevated seat.

24. The device of claim 21 further comprising cushions secured to the first and second panels.

25. The device of claim 24 wherein said cushion secured to said second panel has a clearance hole for receiving a pedestal of an elevated seat.

26. The device of claim 12 further comprising means pivotally connecting together said first and second panels near adjacent longitudinal edges, cushions secured to said first and second panels and positive stop for said first panel when in the bench seat with a backrest position, wherein said cushions are resilient and are beveled at their adjacent longitudinal edges to facilitate positioning the first and second panels in generally right angular positions, and have a slight interference fit so as to yieldably urge the first panel into firm engagement with such positive stop when in the bench seat with a backrest position.

27. The device of claim 12 further comprising a fourth panel, having its upper longitudinal edge adjacent a longitudinal edge of said third panel.

28. The device of claim 27 further comprising means pivotally connecting said third and fourth panels near adjacent longitudinal edges.

29. The device of claim 27 further comprising a piano hinge pivotally connecting together said third and fourth panels near adjacent longitudinal edges.

30. The device of claim 12 further comprising a floor panel constructed and arranged to support said device.

* * * * *

UNITED STATES PATENT AND TRADEMARK OFFICE

CERTIFICATE OF CORRECTION

PATENT NO. : 4,738,217

DATED : April 19, 1988

INVENTOR(S) : Delbert G. Smith

It is certified that error appears in the above-identified patent and that said Letters Patent are hereby corrected as shown below:

In Column 4, line 67 (Claim 12, line 5), after "Connected to said" insert -- second --

Signed and Sealed this

Twenty-third Day of August, 1988

*Attest:*

*Attesting Officer*

DONALD J. QUIGG

*Commissioner of Patents and Trademarks*